US008863417B2

(12) United States Patent
Gerstner

(10) Patent No.: US 8,863,417 B2
(45) Date of Patent: Oct. 21, 2014

(54) END STAND DISPLAY SYSTEM AND SIDE SADDLE DISPLAY AND PRODUCT HOLDER

(71) Applicant: Menasha Corporation, Neenah, WI (US)

(72) Inventor: Tom Gerstner, Sussex, WI (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 13/657,055

(22) Filed: Oct. 22, 2012

(65) Prior Publication Data

US 2013/0097903 A1 Apr. 25, 2013

Related U.S. Application Data

(60) Provisional application No. 61/550,968, filed on Oct. 25, 2011.

(51) Int. Cl.

| | |
|---|---|
| ***G09F 1/08*** | (2006.01) |
| ***G09F 7/18*** | (2006.01) |
| ***G09F 27/00*** | (2006.01) |
| ***G09F 25/00*** | (2006.01) |
| ***G09F 13/00*** | (2006.01) |
| *A47F 5/00* | (2006.01) |

(52) U.S. Cl.

CPC *G09F 13/00* (2013.01); *G09F 7/18* (2013.01); *G09F 27/005* (2013.01); *A47F 2005/0075* (2013.01); *G09F 2007/1856* (2013.01); *G09F 25/00* (2013.01)

USPC ..... 40/539; 40/606.01

(58) Field of Classification Search

USPC ..... 40/661.08, 672.539, 606.02, 606.01; 211/660, 667, 4.03, 4.28, 4.31

See application file for complete search history.

(56) References Cited

U.S. PATENT DOCUMENTS

| | | | | |
|---|---|---|---|---|
| 1,557,332 | A * | 10/1925 | Robbins | 40/312 |
| 1,827,008 | A | 10/1931 | Huckel | |
| 1,912,847 | A | 6/1933 | Earl | |
| 1,992,373 | A | 2/1935 | Johnson | |
| 2,005,924 | A * | 6/1935 | Wilson | 229/242 |
| 2,018,707 | A | 10/1935 | Daller | |

(Continued)

FOREIGN PATENT DOCUMENTS

| | | |
|---|---|---|
| EP | 0629557 A1 | 12/1994 |
| JP | 06278746 | 10/1994 |

OTHER PUBLICATIONS

LeBlanc, Rick; "Limits on Export Pallets Creating Corrugated Window of Opportunity; Corrugated Pallet Suppliers Experiencing Renewed Interest for Export, Domestic Markets"; http://www.palletenterprise.com/articledatabase/view.asp?articleID=648; 7 pages; Apr. 1, 2002.

(Continued)

*Primary Examiner* — Casandra Davis

(74) *Attorney, Agent, or Firm* — Ungaretti & Harris LLP

(57) ABSTRACT

A display system for use with an end stand or end cap shelving system is provided. The display system is formed from a first blank of material and a second blank of material. The blanks are cut and provided with fold lines, score lines and perforations necessary to fold the blanks into a set up display system. A lighting system can be incorporated into the display system. A side saddle display and product holder is also provided.

22 Claims, 5 Drawing Sheets

(56) References Cited

U.S. PATENT DOCUMENTS

D104,437 S 5/1937 Bulman
2,339,656 A 1/1944 Shina
D146,386 S 2/1947 Shield
D153,188 S 3/1949 Stensgaard
D158,775 S 5/1950 Malkin
D158,776 S 5/1950 Malkin
2,706,066 A 4/1955 Wells
2,798,685 A 7/1957 Mooney
2,944,555 A 7/1960 Peel et al.
2,975,890 A 3/1961 Block
3,000,602 A 9/1961 O'Brien
3,026,015 A 3/1962 Severn
3,026,078 A 3/1962 Simkins
3,058,646 A 10/1962 Guyer
3,161,341 A 12/1964 Farquhar
D204,434 S 4/1966 Kingsford
3,480,196 A 11/1969 Simas
3,528,559 A 9/1970 Miller
3,690,118 A 9/1972 Rainwater
3,696,990 A 10/1972 Dewhurst
3,730,417 A 5/1973 Lawson
3,857,494 A 12/1974 Giardini
3,879,053 A 4/1975 Chvala
3,886,348 A 5/1975 Jonathan et al.
3,944,128 A 3/1976 Hogan
D239,805 S 5/1976 South
4,004,691 A 1/1977 Wihksne
D244,117 S 4/1977 Naylor
4,085,847 A 4/1978 Jacalone
4,099,813 A 7/1978 Olivan
4,171,741 A 10/1979 Fish
4,283,000 A 8/1981 White
4,292,901 A 10/1981 Cox
4,375,874 A 3/1983 Leotta et al.
4,376,558 A 3/1983 Bandar
4,503,973 A 3/1985 Andersson
D278,493 S 4/1985 Brescia et al.
4,602,735 A 7/1986 Aaron
4,610,355 A 9/1986 Maurer
4,618,115 A 10/1986 Belokin, Jr.
4,658,984 A 4/1987 Brunner
4,673,092 A 6/1987 Lamson et al.
4,688,716 A 8/1987 Winterling
D292,659 S 11/1987 Svezia et al.
D293,520 S 1/1988 Ovitz, III
4,722,473 A 2/1988 Sandrini et al.
D294,908 S 3/1988 Childress
4,756,409 A * 7/1988 Murray ..... 206/459.5
4,765,492 A 8/1988 Howard et al.
4,793,664 A 12/1988 Jackson
4,826,265 A 5/1989 Hockenberry
4,836,379 A 6/1989 Shaw
4,850,284 A 7/1989 DeGroot et al.
4,852,756 A 8/1989 Holladay
4,863,024 A 9/1989 Booth
4,871,067 A 10/1989 Valenti
4,877,137 A 10/1989 Govang et al.
4,911,084 A 3/1990 Sato et al.
4,936,470 A 6/1990 Prindle
D321,100 S 10/1991 Dorrell
D321,295 S 11/1991 Nuebler
D321,615 S 11/1991 Lavine et al.
5,067,418 A 11/1991 Carter
5,119,740 A 6/1992 Carter
5,125,520 A 6/1992 Kawasaki
5,176,265 A 1/1993 Bennett
D332,883 S 2/1993 Staude
5,195,440 A 3/1993 Gottlieb
5,213,220 A 5/1993 McBride
5,259,631 A 11/1993 Brande
5,269,219 A 12/1993 Juvik-Woods
5,272,990 A 12/1993 Carter
D349,202 S 8/1994 Eliades et al.
D351,076 S 10/1994 Eliades et al.
5,357,875 A 10/1994 Winebarger et al.
5,388,531 A 2/1995 Crews et al.
5,413,053 A 5/1995 Vannatta
5,427,019 A 6/1995 Moorman
D362,768 S 10/1995 Lechleiter et al.
D363,840 S 11/1995 Weshler
5,465,672 A 11/1995 Boyse et al.
5,487,344 A 1/1996 Hutchison
5,487,345 A 1/1996 Winebarger et al.
D369,035 S 4/1996 Potter
D369,043 S 4/1996 Parker
5,520,120 A 5/1996 Badger
5,528,994 A 6/1996 Iseli
5,540,536 A 7/1996 Hoedl
5,543,205 A 8/1996 Liebel
5,590,606 A 1/1997 Crews et al.
5,603,258 A 2/1997 Besaw
5,622,306 A 4/1997 Grigsby et al.
5,672,412 A 9/1997 Phares et al.
5,685,234 A 11/1997 Grigsby et al.
D388,905 S 1/1998 Wells
5,706,953 A 1/1998 Polvere
5,711,423 A 1/1998 Fuller, Jr.
D395,534 S 6/1998 Besaw
5,762,213 A 6/1998 Heneveld, Sr.
5,791,487 A 8/1998 Dixon
5,794,542 A 8/1998 Besaw
5,797,499 A 8/1998 Pinco
D398,461 S 9/1998 Baluk et al.
D398,462 S 9/1998 Baluk et al.
5,809,903 A 9/1998 Young, Jr.
5,816,172 A 10/1998 Carter
5,826,732 A 10/1998 Ragsdale
5,832,841 A 11/1998 Crews et al.
5,881,652 A 3/1999 Besaw
D412,253 S 7/1999 Brozak, Jr.
5,918,744 A 7/1999 Bringard et al.
5,950,914 A 9/1999 Dunton et al.
5,980,008 A 11/1999 Stoever
5,996,366 A 12/1999 Renard
5,996,510 A 12/1999 Harpman et al.
D419,275 S 1/2000 Carter
D419,744 S 1/2000 Carter
6,012,399 A 1/2000 Carter
6,070,726 A 6/2000 Graham
6,076,475 A 6/2000 Kuhn et al.
D428,738 S 8/2000 Brozak, Jr.
6,126,131 A 10/2000 Tietz
6,135,030 A 10/2000 Besaw
D433,782 S 11/2000 Carter
D433,839 S 11/2000 Culbertson
6,145,671 A 11/2000 Riga et al.
6,164,215 A 12/2000 Cook et al.
6,189,778 B1 2/2001 Kanter
D453,057 S 1/2002 Sewell
6,354,229 B1 3/2002 Heidtke
6,357,587 B1 3/2002 Melms, Jr.
6,394,003 B1 5/2002 Lacy, III
D461,334 S 8/2002 Johnson et al.
D464,498 S 10/2002 Riga et al.
6,510,982 B2 1/2003 White et al.
6,585,118 B2 7/2003 Kellogg
6,612,247 B1 9/2003 Pistner et al.
6,659,295 B1 12/2003 De Land et al.
6,715,623 B2 4/2004 Broerman
6,729,484 B2 5/2004 Sparkowski
6,769,368 B2 8/2004 Underbrink et al.
D495,901 S 9/2004 Bosman
6,814,245 B2 11/2004 Leclerc et al.
6,902,074 B2 6/2005 Albrecht
6,905,021 B2 6/2005 Polumbaum et al.
D509,382 S 9/2005 Raile
6,951,300 B2 10/2005 Caille et al.
D521,275 S 5/2006 Dusenberry
7,036,196 B2 5/2006 Salatin et al.
7,066,342 B2 6/2006 Baechle et al.
7,066,380 B2 6/2006 Blake
7,089,872 B2 8/2006 Wintermute, II et al.
7,111,735 B2 9/2006 Lowry
7,137,517 B2 11/2006 Lowry et al.

(56) References Cited

U.S. PATENT DOCUMENTS

| | | | | |
|---|---|---|---|---|
| D533,734 | S | 12/2006 | Campbell | |
| 7,191,906 | B1 | 3/2007 | Pinco | |
| 7,234,604 | B2 | 6/2007 | Eisele | |
| D566,989 | S | 4/2008 | Mason | |
| D576,426 | S | 9/2008 | Yuen-Schat et al. | |
| D578,804 | S | 10/2008 | Norman et al. | |
| 7,546,926 | B2 | 6/2009 | Stolle et al. | |
| 7,546,927 | B2 | 6/2009 | Lowry et al. | |
| D603,189 | S | 11/2009 | Raile | |
| 7,650,996 | B2 | 1/2010 | Mark | |
| 7,677,433 | B2 | 3/2010 | Little | |
| 7,703,665 | B2 | 4/2010 | McGowan | |
| 7,703,864 | B2 | 4/2010 | Moser | |
| 7,717,265 | B2 | 5/2010 | Honkawa et al. | |
| 7,726,474 | B2 | 6/2010 | Berger et al. | |
| 7,828,169 | B2 | 11/2010 | Robinson et al. | |
| 7,886,465 | B2 * | 2/2011 | Virvo | 40/539 |
| 7,992,716 | B2 | 8/2011 | Jackson | |
| 8,002,171 | B2 | 8/2011 | Ryan et al. | |
| 8,141,713 | B2 | 3/2012 | Farkas et al. | |
| 8,291,629 | B2 * | 10/2012 | Silverstein et al. | 40/606.01 |
| 8,317,039 | B2 | 11/2012 | Norman | |
| 2002/0139808 | A1 * | 10/2002 | Grueneberg | 220/751 |
| 2002/0189507 | A1 | 12/2002 | Benner | |
| 2003/0042828 | A1 | 3/2003 | Bonin | |
| 2003/0111383 | A1 | 6/2003 | Qiu et al. | |
| 2005/0252872 | A1 | 11/2005 | Eisele | |
| 2006/0006096 | A1 | 1/2006 | Funk | |
| 2006/0283775 | A1 | 12/2006 | Mark | |
| 2007/0193479 | A1 | 8/2007 | Slaats | |
| 2009/0107940 | A1 | 4/2009 | Norman et al. | |
| 2009/0127150 | A1 | 5/2009 | Meers | |
| 2010/0133215 | A1 | 6/2010 | Norman | |
| 2011/0000955 | A1 | 1/2011 | Manteufel et al. | |
| 2011/0049072 | A1 | 3/2011 | Dewhurst | |
| 2011/0266177 | A1 | 11/2011 | Lowry et al. | |
| 2012/0074037 | A1 | 3/2012 | Orischak et al. | |
| 2013/0097903 | A1 * | 4/2013 | Gerstner | 40/541 |

OTHER PUBLICATIONS

"Solid Wood Packing Materials to Argentina"; http://www.corrugatedprices.com/pallets/swang.html; 2 pages; Feb. 5, 2002.

* cited by examiner

END STAND DISPLAY SYSTEM AND SIDE SADDLE DISPLAY AND PRODUCT HOLDER

CROSS-REFERENCE TO RELATED APPLICATIONS

The present application claims the benefit of U.S. Provisional Application No. 61/550,968 filed Oct. 25, 2011, the contents of which are incorporated herein.

FEDERALLY SPONSORED RESEARCH OR DEVELOPMENT

N/A

FIELD OF THE INVENTION

The present invention generally relates to an end stand display system for placement on shelving typically found at an end of an aisle, and to a side saddle display and product holder that can be used with the end stand display system.

DESCRIPTION OF THE PRIOR ART

A variety of signage is utilized to advertise and provide information relevant to products sold in the store. New ways of bringing attention to such products are constantly being sought. The present invention provides an innovative signage display system for use on shelving displays in a store, and an additional display and/or product holder.

SUMMARY OF THE INVENTION

The present invention provides a display system that can be placed on the top shelf of a shelving stand. In particular, the display system can be utilized for an end stand or end cap shelving typically found at the end of an aisle in a store. The display system can be easily assembled and secured to the shelving stand. The display system can be used to advertise and provide information relating to products for sale that can be placed on the shelving system on which the display system is placed. The display system is preferably configured to draw attention from a consumer toward the display system and products displayed on the end stand or end cap at issue.

Additionally, in one embodiment, the display system can include a light display as part of the display system. The light display can include a plurality of LED lights powered by batteries held in a housing positioned behind the display system.

Other than the lighting components, the other main portions of the display system can be formed by paper products, such as paperboard or a corrugated cardboard. Other suitable materials could also be used.

The paper products can be in the form of a first blank and a second blank. The first and second blanks can be cut, scored, perforated or otherwise similarly formed or configured to collectively create the desired structure of the display system.

In accordance with one embodiment, a display system for placement on a shelving system is provided. The display system comprises a first lower back portion having a first slot for connection to a first side wall of a shelf and a second slot for connection to a second side wall of the shelf. The display system further includes a second upper back portion having a display panel. A first arm is connected on one side of the display panel. The first arm is foldable to extend over the first side wall. A second arm is connected on a second side of the display panel. The second arm is foldable to extend over the second side wall.

The display system can further comprise a flap connected to the first arm for placement on a forward facing portion of the first side wall. Similarly, the display system can further comprise a flap connected to the second arm for placement on a forward facing portion of the second side wall. Preferably, the display system is positioned on the topmost shelf of an end stand or end cap shelving system.

The display system can further comprise a compartment positioned behind the upper back portion. The compartment can be utilized to house lights, batteries and other related circuitry or switches, for use with the display system. The lights can be LEDs or other similar lights and can be coupled to the batteries via wires. The lights can be positioned in a variety of locations on the display system and are not necessarily limited to being positioned in the compartment.

The first lower back portion can be formed from a first single blank of material. Similarly, the second upper back portion, first arm and second arm can be formed from a second single blank of material. The blanks can be formed from a paperboard or a corrugated material and/or any other suitable materials.

Additionally, the present invention includes a side saddle display and product holder. The products in the holder are removed from an opening in a lower portion of the holder. Accordingly, gravity feeds the next products being held to the opening. The side saddle can attach to the end cap display system described herein.

The side saddle can be formed from a single blank of material that can be folded into the appropriate structure. The side saddle is a generally rectangular hollow structure that can be mounted to an end aisle. The saddle includes an opening proximate a bottom portion exposing product carried in the structure. Removing product from the opening enables any remaining product to slide down (under gravity) and be available through the opening for the next customer.

In accordance with one embodiment of the invention, a side saddle is provided. The side saddle includes a generally rectangular body having a front side wall, a first side wall, a back wall and a second side wall. An opening is formed in a lower portion of the front side wall, first side wall and second side wall allow access and exposure of products contained in the side saddle. A bottom wall including a first tab configured for placement in a slot in the back side wall is also included.

In accordance with another embodiment of the invention, a display system for use on the top of a shelving system having a top shelf with a back wall, a first side wall and a second side wall is provided. The display system comprises a first lower back portion positionable against the back wall of the top shelf and extending from the first side wall to the second side wall. A second upper back portion is connected to the first lower back portion and extends above the first lower back portion. The second upper back portion includes a central portion generally parallel to the first lower back portion. A first arm extends forward from the second upper back portion above the first side wall of the top shelf and, a second arm extends forward from the second upper back portion above the second side wall of the top shelf.

The first lower back portion can include a first slot for connecting the first lower back portion to the first side wall of the top shelf and a second slot for connecting the first lower back portion to the second side wall of the top shelf. Other similar connection means can also be utilized.

The first arm and the second arm of the second upper back portion can be integrally formed with the second upper back portion. The arms can be part of the same blank of material and can be folded forward upon use.

The display system can further comprise an electronics housing compartment. The electronics housing compartment can be formed from an extension of the second upper back portion that is folded into a position behind the second upper back portion. This causes some separation between the second upper back portion and the first lower back portion, such that the second upper back portion is positioned forward of the first lower back portion. The electronics housing compartment can hold batteries and other electronic components used with the display system.

The display system can include lights (e.g., LEDs) electronically connected to the electronics housing compartment. The display system can also include a speaker connected to an audio device in the electronics housing compartment.

In accordance with another embodiment, a display system for use with a shelving system which is formed from a single blank of material is provided. The display system comprises a back portion having a lower portion connectable to a back wall of a top shelf of a shelving system and an upper portion that extends above the back wall of the top shelf. The display system includes a first arm extending forward from a first side of the upper portion of the back portion above a first side wall of the top shelf and, a second arm extending forward from a second side of the upper portion of the back portion above a second side wall of the top shelf.

The first and second arms are integrally formed with the back portion. The arms are folded forward and can include flaps to secure the front portion of the arms to the front of the side walls of the shelf.

The display system can further comprise a plurality of pegs for securing the lower portion of the back portion to the back wall of the top shelf. Alternatively, other means, such as glue can be used to secure the lower portion of the back portion to the back of the top shelf.

Further aspects of the invention are disclosed in the description of the invention, including the Figures.

BRIEF DESCRIPTION OF THE DRAWINGS

To understand the present invention, it will now be described by way of example, with reference to the accompanying drawings in which.

DETAILED DESCRIPTION

Figure 1:
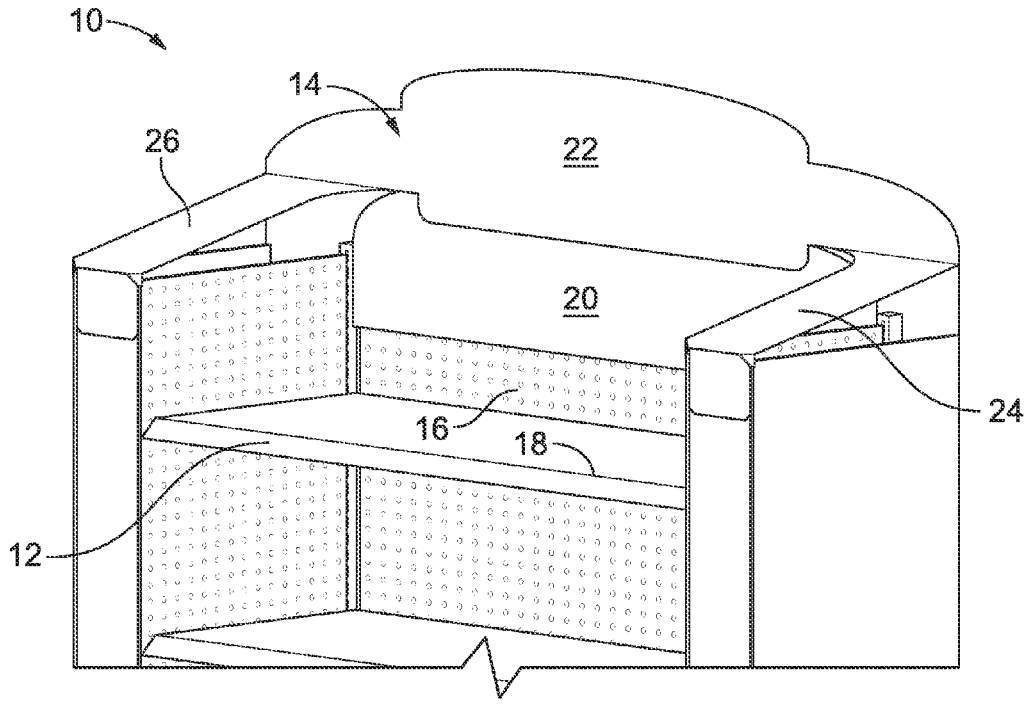
FIG. 1 is a perspective view of the end stand display system of the present invention.

While this invention is susceptible of embodiments in many different forms, there is shown in the drawings what will herein be described in detail preferred embodiments of the invention with the understanding that the present disclosure is to be considered as an exemplification of the principles of the invention and is not intended to limit the broad aspect of the invention to the embodiments illustrated.

As illustrated in FIG. 1, a display system 10 for placement on the top shelf of a shelving system 12 is shown. The display system 10 is particularly suitable for an end of aisle or end cap display.

The display system 10 includes a back portion 14 designed to be positioned at the back wall 16 of the topmost shelf 18 of the shelving system 12. The back portion 14 of the display system 10 has a lower back wall portion 20 and an upper back wall portion 22. A first arm 24 extends from one side of the upper back wall portion 22 to the front of one side of the topmost shelf 18, and a second arm 26 extends from a second side of the upper back wall portion 22 to a second side of the topmost shelf 18. As is evident in FIG. 1, the upper back wall portion 22 extends slightly away from the lower back portion 20 toward the front of the topmost shelf 18. This slight separation is to accommodate batteries and lights for a light display that can be utilized with the display system 10.

Figure 2:
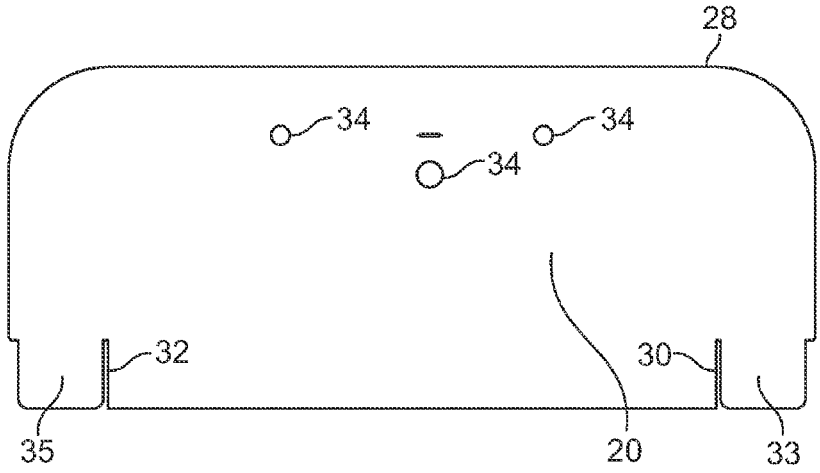
FIG. 2 is a blank for forming a first component of the end stand display system of FIG. 1.

FIG. 2 is a first blank 28 for forming a first component of the display system 10 of FIG. 1. The first blank 28 forms the lower back wall portion 20 of the back portion 14 of the set up display system 10. The first blank 28 is generally rectangular with rounded upper corners. The first blank 28 includes a first slot 30 and a second slot 32 in a lower portion of the first blank 28. The first and second slots 30, 32 are used to slide the first blank 28 over a first side wall and a second side wall of the topmost shelf 18, respectively. A first tab segment 33 and a second tab segment 35 are positioned between the respective slots 30, 32 and the first side and second side of the first blank 28. The tabs 33, 35 are sized and configured to be placed between an inner wall and an outer wall of the first and second side walls of the topmost shelf 18 when such walls are of double walled construction.

The first blank 28 includes a plurality of apertures 34. The apertures 34 can be utilized with connectors to secure the first blank 28 to other components of the display system 10.

Figure 3:
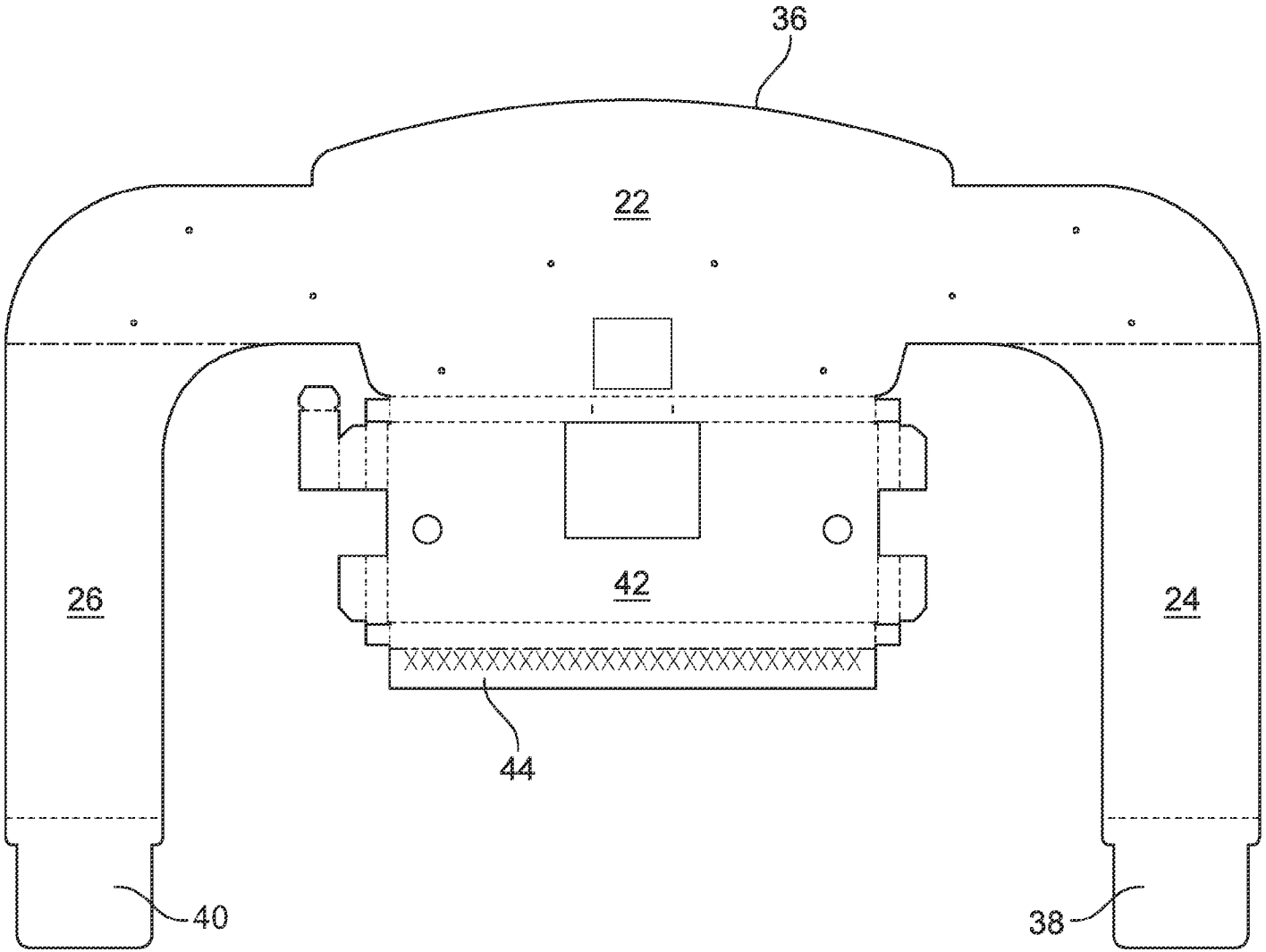
FIG. 3 is a is a blank for forming a second component of the end stand display system of FIG. 1.

FIG. 3 shows a second blank 36 for forming a second component of the display system 10 of FIG. 1. The second blank 36 forms the upper back wall portion 22 of the back portion 14 of the display system 10 when set up. The second blank 36 also includes and forms the first arm 24 and the second arm 26 of the set up display system 10. The first arm 24 includes a downward flap 38 at a distal end of the first arm 24. The second arm 26 similarly includes a downward flap 40 at a distal end of the second arm 26. The downward flaps 38, 40 can be used to secure the arms 24, 26 to the front of the side walls of the topmost shelf 18.

The second blank 36 also includes a foldable compartment 42 connected to and extending below the upper back portion 22 that is used to house batteries, light assemblies and related circuitry and switches, which can be used with the display system 10. The foldable compartment 42 includes suitable score and/or fold lines, and a glue panel 44 (glue is indicated by "XXXX . . . " pattern) to fold and create the compartment for placement behind the upper back portion 22. Lights (such as LEDs) can be positioned throughout the display system and be electrically connected to the batteries in the compartment. Similarly, a speaker can be placed on the display system (or in the compartment) and be set up to provide audible information or music. A motion detector can be utilized with the other electronic components of the system. The compartment can hold switches and other circuitry for operating the lights or speaker.

Graphics, illustrations, product information, etc. can be displayed on the display system 10. Products advertised or promoted by the display system 10 can be placed on the shelving system immediately below the display system.

Figure 4:
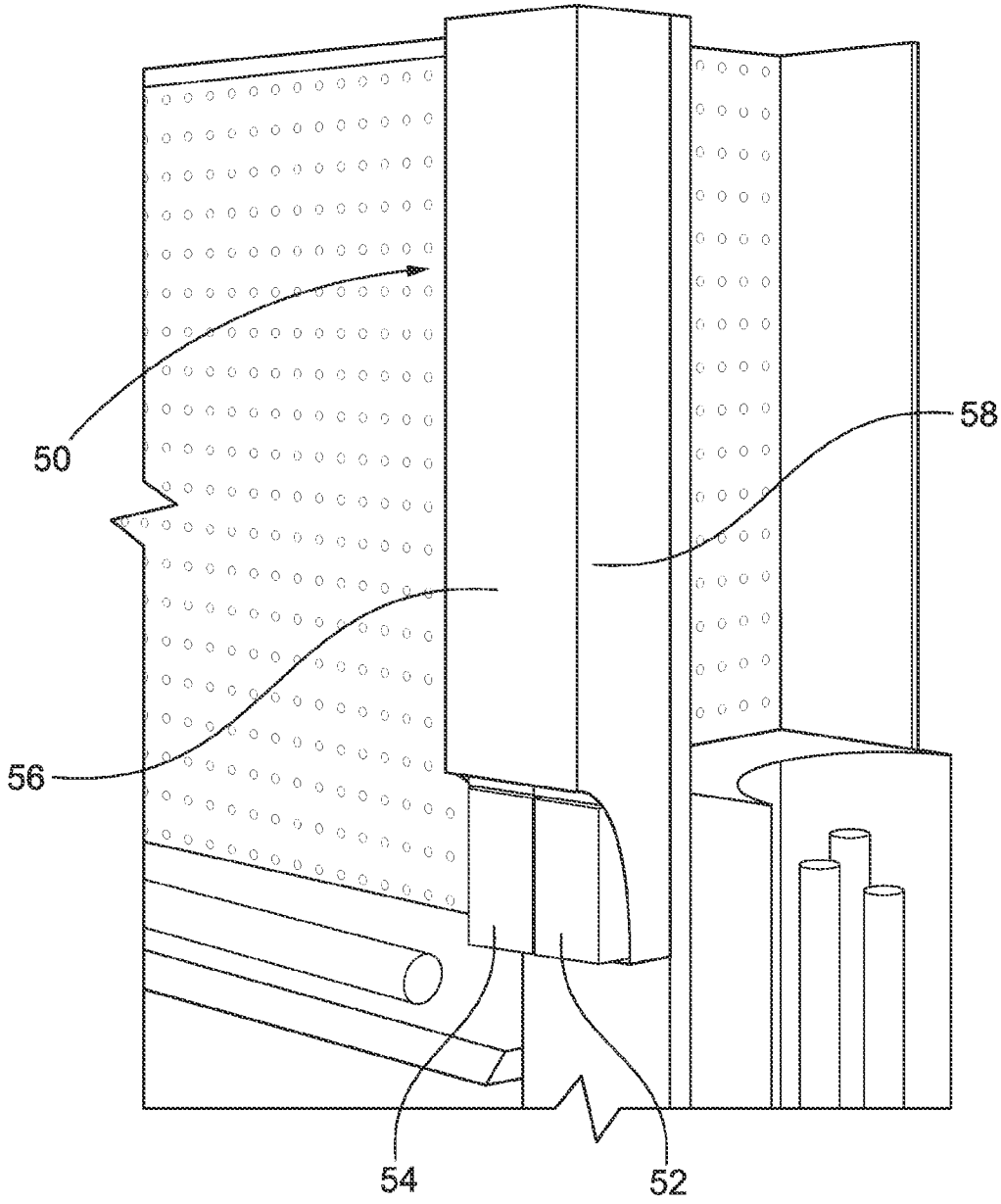
FIG. 4 is a perspective view of a side saddle display and product holder in accordance with another aspect of the present invention.

Referring to FIG. 4, a side saddle display and product holder 50 (hereafter "side saddle") is shown. The side saddle 50 can be connected to or, in some embodiments, located next to or proximate the display system 10 discussed above.

The side saddle 50 is a generally rectangular hollow container having a lower opening 52 for exposing products 54 contained in the interior of the side saddle 50. The lower most products 54 are shown in the opening 52. Other products are positioned in the interior of the container above the lower most products. The side saddle 50 can be formed from a single blank of material like that shown in FIG. 5.

Figure 5:
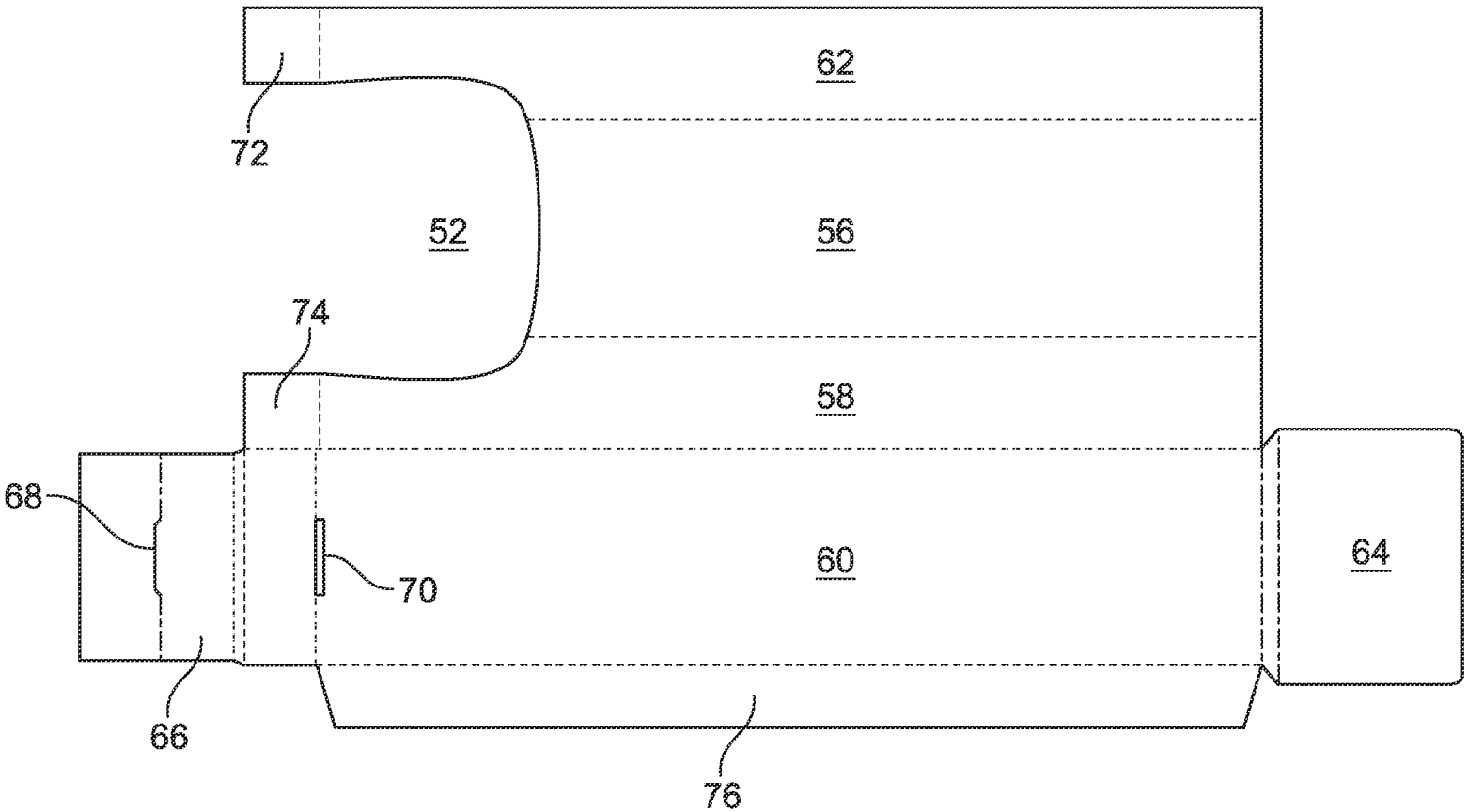
FIG. 5 is a plan view of a blank for forming the side saddle display of FIG. 4.

Referring to both FIGS. 4 and 5, the side saddle 50 includes a first or front side wall 56, a second side wall 58, a third or back side wall 60, and a forth side wall 62. The opening 52 is formed in a lower portion of the first side wall 56, as well as portions of the second side wall 58 and fourth side wall 62. The side saddle 50 includes a top 64.

The side saddle 50 also includes a bottom wall 66 extending from a lower portion of the third or back wall 60. As shown in FIG. 5, the bottom 66 includes a foldable panel having a tab 68 that is inserted into a slot 70. The bottom 66 is designed to be sturdy to support the products 54 contained in the side saddle 50. Flaps 72 and 74 extending from a lower portion of the second sidewall 58 and the fourth side wall 62, respectively, are also used as part of the bottom of the side saddle 50.

The blank for forming the side saddle 50 can be die cut to the desired shape and provided with appropriate fold and/or score lines to enable one to easily assemble the blank into the set up side saddle 50 display. A glue tab or panel 76 can be provided along one side wall (e.g., the back wall 60) for connecting the side walls. All of the side walls and panels are integrally connected because the blank is formed from a single sheet of material.

The side saddle 50 can contain graphics, illustrations, product information, etc., on one or more of the side walls. The side saddle 50 can be formed from paperboard, cardboard, or other similar or suitable materials.

In operation, once set up, the side saddle is filled with products 54. When placed for use in a store, removal of products 54 from the opening 52 allows additional products in the side saddle to move down (under gravity) and replace the removed products in the opening 52.

Figure 6:
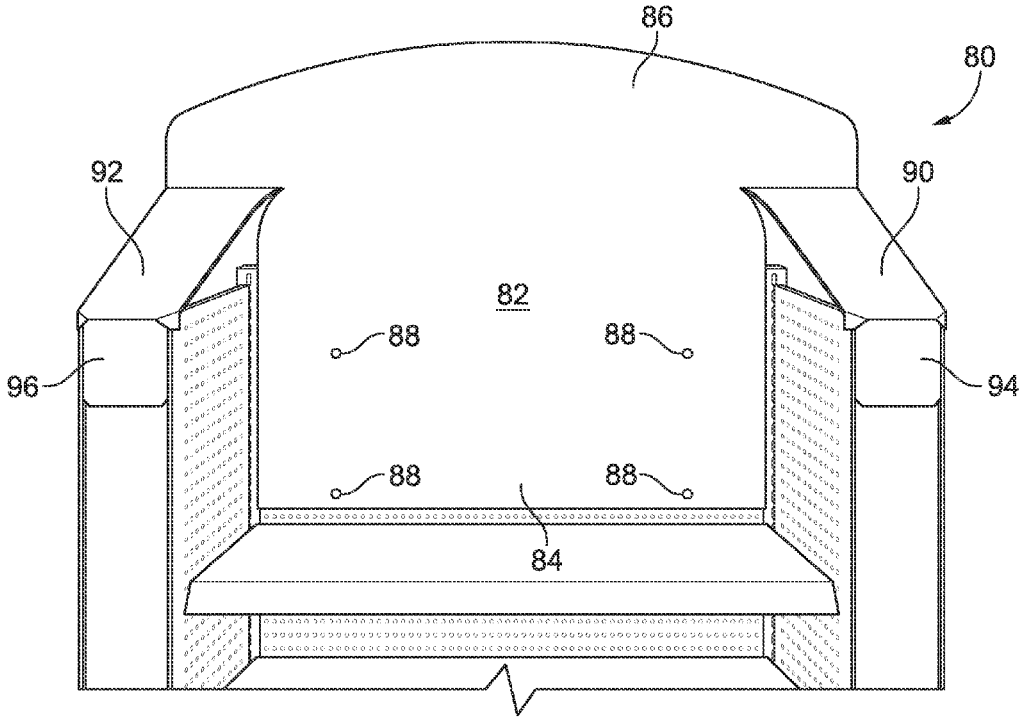
FIG. 6 is a perspective view of another embodiment of an end stand display system in accordance with the present invention; and, FIG. 7 is blank for forming the end stand display of FIG. 6.
Figure 7:
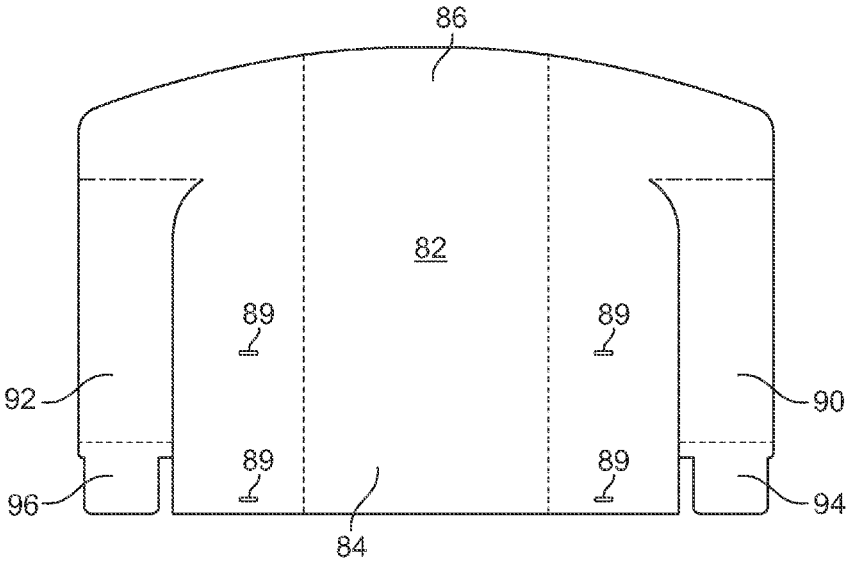

FIGS. 6 and 7 illustrate another embodiment of an end display system 80 of the present invention. As shown, the end display system 80 is formed from a single blank of material. The end display system includes a back portion 82 that includes a lower back portion 84 that contacts the back of the top shelf, and an upper back portion 86 that extends upward above the back wall of the top shelf.

The lower back portion 84 is connected to the back wall of the top shelf by pegs 88 (e.g., pins, nails, tacks, etc.). As illustrated in FIG. 7, the blank is provided with apertures or slots 89 for the pegs. Other conventional means, such as clips, glue, etc. can be used to secure the lower back portion 84 to the shelf.

The end display system 80 includes a first arm 90 that extends over the first side wall of the top shelf, and a second arm 92 that extends over the second side wall of the top shelf. Each arm 90, 92 includes a flap 94, 96, respectively, that can be used to secure the front of the arm to the shelf.

As shown, the arms 90, 92 are integrally formed with the back portion 82 and are folded forward. Similar to the first embodiment of the end display system 10, the fold lines are positioned higher than the side walls of the shelf so that the arms slant downward.

Although not shown, the end display system 80 can include graphics and other indicia as desired to promote goods and/or services.

Many modifications and variations of the present invention are possible in light of the above teachings. It is, therefore, to be understood within the scope of the appended claims the invention may be protected otherwise than as specifically described.

I claim:

1. A display system for placement on a shelving system comprising:

a first lower back portion having a first slot for connection to a first side wall of a shelf proximate a back of the shelving system and a second slot for connection to a second side wall of the shelf proximate the back of the shelving system;

a second upper back portion having a display panel connected to the first lower back portion, a first arm connected on one side of the display panel by a first horizontal fold line, the first arm foldable to extend on a downward slope from an upper portion of the second upper back portion over the first side wall toward a front of the shelving system, and a second arm connected on a second side of the display panel by a second horizontal fold line, the second arm foldable to extend on a downward slope from the upper portion of the second upper back portion over the second side wall toward the front of the shelving system;

wherein the first arm is folded about the first horizontal fold line to extend forward of the first lower back portion and the second arm is folded about the second horizontal fold line to extend forward of the first lower back portion.

2. The display system of claim 1 further comprising a flap connected to the first arm for placement on a forward facing portion of the first side wall.

3. The display system of claim 1 further comprising a flap connected to the second arm for placement on a forward facing portion of the second side wall.

4. The display system of claim 1 further comprising a compartment positioned behind the upper back portion, the compartment housing lights and batteries for use with the display system.

5. The display system of claim 1 wherein the first lower back portion is formed from a first single blank of material.

6. The display system of claim 5 wherein the second upper back portion, first arm and second arm are formed from a second single blank of material.

7. The display system of claim 6 wherein the first single blank and the second single blank are formed from paperboard.

8. The display system of claim 6 wherein the first single blank and the second single blank are formed from a corrugated material.

9. The display system of claim 1 further comprising:

a side saddle having a generally rectangular body having a front side wall, a first side wall, a back wall and a second side wall, an opening in a lower portion of the front side wall, first side wall and second side wall, a bottom wall including a first tab configured for placement in a slot in the back side wall.

10. The display system of claim 9 wherein the body of the side saddle is formed from a blank formed from a single sheet of material.

11. A display system for use with a shelving system comprising:

a back portion having a lower portion connectable to a back wall of a top shelf of a shelving system and an upper portion that extends above the back wall of the top shelf;

a first arm extending forward from a first side of the upper portion of the back portion above a first side wall of the top shelf;

a second arm extending forward from a second side of the upper portion of the back portion above a second side wall of the top shelf; and, a plurality of pegs for securing the lower portion of the back portion to the back wall of the top shelf.

12. The display system of claim 11 wherein the first arm and the second arm are integrally formed with the back portion.

13. A display system for use on the top of a shelving system having a top shelf with a back wall, a first side wall and a second side wall, the display system comprising:

a first lower back portion positionable against the back wall of the top shelf and extending from the first side wall to the second side wall, wherein the first lower back portion includes a first slot for connecting the first lower back portion to the first side wall of the top shelf and a second slot for connecting the first lower back portion to the second side wall of the top shelf;

a second upper back portion connected to the first lower back portion and extending above the first lower back portion, the second upper back portion including a central portion generally parallel to the first lower back portion;

a first arm extending forward from the second upper back portion above the first side wall of the top shelf on a downward slope to a front of the shelving system; and a second arm extending forward from the second upper back portion above the second side wall of the top shelf on a downward slope to a front of the shelving system;

wherein the first arm is folded about a first horizontal fold line and the second arm is folded about a second horizontal fold line to extend forward of the first lower back portion.

14. The display system of claim 13 wherein the first arm and the second arm are integrally formed with the second upper back portion.

15. The display system of claim 13 further comprising an electronics housing compartment.

16. The display system of claim 15 wherein the electronics housing compartment is formed from an extension of the second upper back portion and is foldable to a position behind the second upper back portion.

17. The display system of claim 16 further comprising lights connected to the electronics housing compartment.

18. The display system of claim 16 further comprising a speaker connected to the electronics housing compartment.

19. A display system for placement on a shelving system comprising:

a first lower back portion having a first slot for connection to a first side wall of a shelf and a second slot for connection to a second side wall of the shelf;

a second upper back portion having a display panel connected to the first lower back portion, a first arm connected on one side of the display panel, the first arm foldable to extend over the first side wall, and a second arm connected on a second side of the display panel, the second arm foldable to extend over the second side wall; and, a compartment positioned behind the upper back portion, the compartment housing lights and batteries for use with the display system.

20. A display system for placement on a shelving system comprising:

a first lower back portion having a first slot for connection to a first side wall of a shelf and a second slot for connection to a second side wall of the shelf; and, a second upper back portion having a display panel connected to the first lower back portion, a first arm connected on one side of the display panel, the first arm foldable to extend over the first side wall on a downward slope to a front of the shelving system, and a second arm connected on a second side of the display panel, the second arm foldable to extend over the second side wall on a downward slope to a front of the shelving system, wherein the first lower back portion is formed from a first single blank of material and the second upper back portion, first arm and second arm are formed from a second single blank of material.

21. A display system for placement on a shelving system comprising:

a first lower back portion having a first slot for connection to a first side wall of a shelf and a second slot for connection to a second side wall of the shelf;

a second upper back portion having a display panel connected to the first lower back portion, a first arm connected on one side of the display panel by a first horizontal fold line, the first arm foldable to over the first side wall, and a second arm connected on a second side of the display panel by a second horizontal fold line, the second arm foldable to extend over the second side wall; and, a compartment positioned behind the upper back portion, the compartment housing lights and batteries for use with the display system.

22. A display system for placement on a shelving system comprising:

a first lower back portion having a first slot for connection to a first side wall of a shelf and a second slot for connection to a second side wall of the shelf;

a second upper back portion having a display panel connected to the first lower back portion, a first arm connected on one side of the display panel by a first horizontal fold line, the first arm foldable to over the first side wall, and a second arm connected on a second side of the display panel by a second horizontal fold line, the second arm foldable to extend over the second side wall; and, a side saddle having a generally rectangular body having a front side wall, a first side wall, a back wall and a second side wall, an opening in a lower portion of the front side wall, first side wall and second side wall, a bottom wall including a first tab configured for placement in a slot in the back side wall.

* * * * *